US007399259B2

(12) United States Patent
Somwong

(10) Patent No.: US 7,399,259 B2
(45) Date of Patent: Jul. 15, 2008

(54) ELEVATING EXERCISE BICYCLE

(76) Inventor: Banyat Somwong, 13063 Strathern St., North Hollywood, CA (US) 91605

( * ) Notice: Subject to any disclaimer, the term of this patent is extended or adjusted under 35 U.S.C. 154(b) by 899 days.

(21) Appl. No.: 10/611,068

(22) Filed: Apr. 22, 2004

(65) Prior Publication Data

US 2005/0239608 A1 Oct. 27, 2005

(51) Int. Cl.
*A63B 22/06* (2006.01)

(52) U.S. Cl. ..... 482/57; 601/36; 73/379.07

(58) Field of Classification Search ..... 482/51–65, 482/95, 96, 148, 1–9; 73/379.07, 379.09; 601/23, 26, 32–63
See application file for complete search history.

(56) References Cited

U.S. PATENT DOCUMENTS 3,750,479 A * 8/1973 Gause et al. ..... 73/379.07
4,191,370 A * 3/1980 Meyer et al. ..... 482/96
5,035,418 A * 7/1991 Harabayashi ..... 482/62
5,782,639 A * 7/1998 Beal ..... 434/29
6,066,073 A * 5/2000 Stearns et al. ..... 482/4
6,251,047 B1 * 6/2001 Stearns et al. ..... 482/4
6,419,613 B2 * 7/2002 Stearns et al. ..... 482/57
6,547,702 B1 * 4/2003 Heidecke ..... 482/62

* cited by examiner

*Primary Examiner*—LoAn H. Thanh
*Assistant Examiner*—Tam Nguyen

(57) ABSTRACT

An Elevating Exercise Bicycle for fitness and amusement ride in one having occupant-seating station with frame attached to a support base frame through an articulating member providing angular rotation about lower pivot pins to create constant pitching angle and vertical movement for occupant-seating station. Hydraulic pressure powered by occupant's energy via foot pedal and a drive chain to the pump increased the pressure inside the hydraulic system. Hydraulic pressure from the pump transferred to a main cylinder lower port, extending the piston rod and pushing an articulating member to move. Angular movement of the articulating member caused an occupant-seated frame to follow in ascending or descending motion depending on piston rod movement.

Each cycle of workout for occupant can be preset to required load level.

2 Claims, 6 Drawing Sheets

ELEVATING EXERCISE BICYCLE

CROSS-REFERENCE TO RELATED APPLICATIONS

"Not applicable"

STATEMENT REGARDING FEDERALLY SPONSORED RESEARCH OR DEVELOPMENT

"Not applicable"

THE NAMES OF THE PARTIES TO A JOINT RESEARCH AGREEMENT

"Not applicable"

INCORPORATION-BY-REFERENCE OF MATERIAL SUBMITTED ON A COMPACT DISC

"Not applicable"

BACKGROUND OF THE INVENTION (1) Field of the Invention

The invention relates generally to the field of fitness industries which simulate exercise bicycle rides and amusement rides with ascending motion.

In particular "Elevating Exercise Bicycle" provides for independent speed and resistance control of vertical motion on upward and predetermined down ward motion.

(2) Prior Art

Existing exercise bicycles for workout and training are well known in the art. Conventional type bicycle simulators for use by the fitness industries and gym are stationary and simple. Elevating Exercise Bicycle offers movement of amusement ride and workout equipment in one. A typical system employs occupant seat with restraint seat belt to prevent accident at the elevated position during the exercise. The seat assembly is mounted on the tubular bicycle frame attached to the parallelogram mechanism to maintain upright position of the occupant back rest on various levels. The seat pitching angle changed some degree when the seat reaches the top most level of the ride to create some excitement. The upper and lower arm of parallelogram are mounted to base flame on one ends and to the bicycle frame on the other ends. The mounting locations of the actuators is determined in geometrical configuration, engineering tradeoffs, equation of motion and safety point of view to be used for the simulation. Three actuator systems for triangular pattern is the minimum on the sophisticated motion base system offering multiple axes of motion. For Elevating Exercise Bicycle, one actuator is required to perform lifting function and one additional actuator is installed to serve as safety cylinder. This cylinder has no lifting capacity.

The cost and complexity for this hydraulic system and frame structure is relative inexpensive for fitness industry and amusement field of applications. The initial and operating cost is in the same level as treadmills and other cardio equipment. In particular in the field of amusement rides, the vertical motion provides excitement and fulfill the purpose as workout machine. The conventional type of exercise bicycle does not offer this kind of function which will attracts the occupant to spent longer time on the equipment for the sake of their health.

BRIEF SUMMARY OF THE INVENTION

The Elevating Exercise Bicycle of the invention incorporates a seat assembly, pedaling system, control and instrument panel. The arrangement of the pedal system and seat assembly is the same as the stationary exercise bicycle. They can be adjusted in vertical and horizontal direction to serve each individual occupant Pedaling resistance is also adjustable to match the required load preferred by individual occupant via flow control valve.

The hydraulic pump installed behind the occupant seat frame and driven by the pedal via a roller chain and sprocket arrangement. The reduction ratio between drive sprocket and driven sprocket at pump shaft to be tested for proper force required to applied on the pedal. Flexible pressure hose connected from pump pressure port to the bottom end of the main hydraulic actuator is furnished with flow control and check valve. Pressure relief valve on the return line to hydraulic oil reservoir is also connected to the bottom end port of the main actuator. The upper port of actuator is open to the atmosphere or furnish with silencer if needed. When operator starts to spin the pedals, hydraulic pump creates oil pressure feeding oil into main actuator. The main actuator rod gradually extend and lifting the upper arm of the parallelogram mechanism. The operator seat frame which is directly attached to the upper and lower arm of this mechanism subsequently moved upward and continue all the way to the end of actuator stroke. The full cycle time for this workout to be set from start to the end in about one half of an hour.

The purpose of the second actuator is to provide safety to the operator in case of main actuator failure caused by hydraulic lines are rupture. Two parallel lines connected between the lower port and upper port of the auxiliary actuator. One line furnished with check valve to prevent oil flow from lower port to upper port but free flow from top to the bottom. The other line is furnished with flow control valve to control flow rate in both directions. The purpose of this arrangement is to reduce the lowering speed in case of main actuator failure. The second actuator to be filled up with hydraulic oil prior to final installation. The lifting height as designed is about four feet from the home position. To lower the seat frame down to the home position, operator need to activate the pressure relief valve switch located on the instrument panel to drain oil from main actuator lower port back to the reservoir tank. The lowering speed is controlled by auxiliary actuator not to exceed predetermined set up.

To obtain the stability, rigidity and torsional stiffen of the bicycle frame, upper and lower arm are designed using A-frame principle and tubular member. The bicycle frame is also fabricated from structural tubing.

BRIEF DESCRIPTION OF THE SEVERAL VIEWS OF THE DRAWINGS

Details of the invention will be clearly understood with reference to the followings.

DETAILED DESCRIPTION OF THE INVENTION

Figure 1:
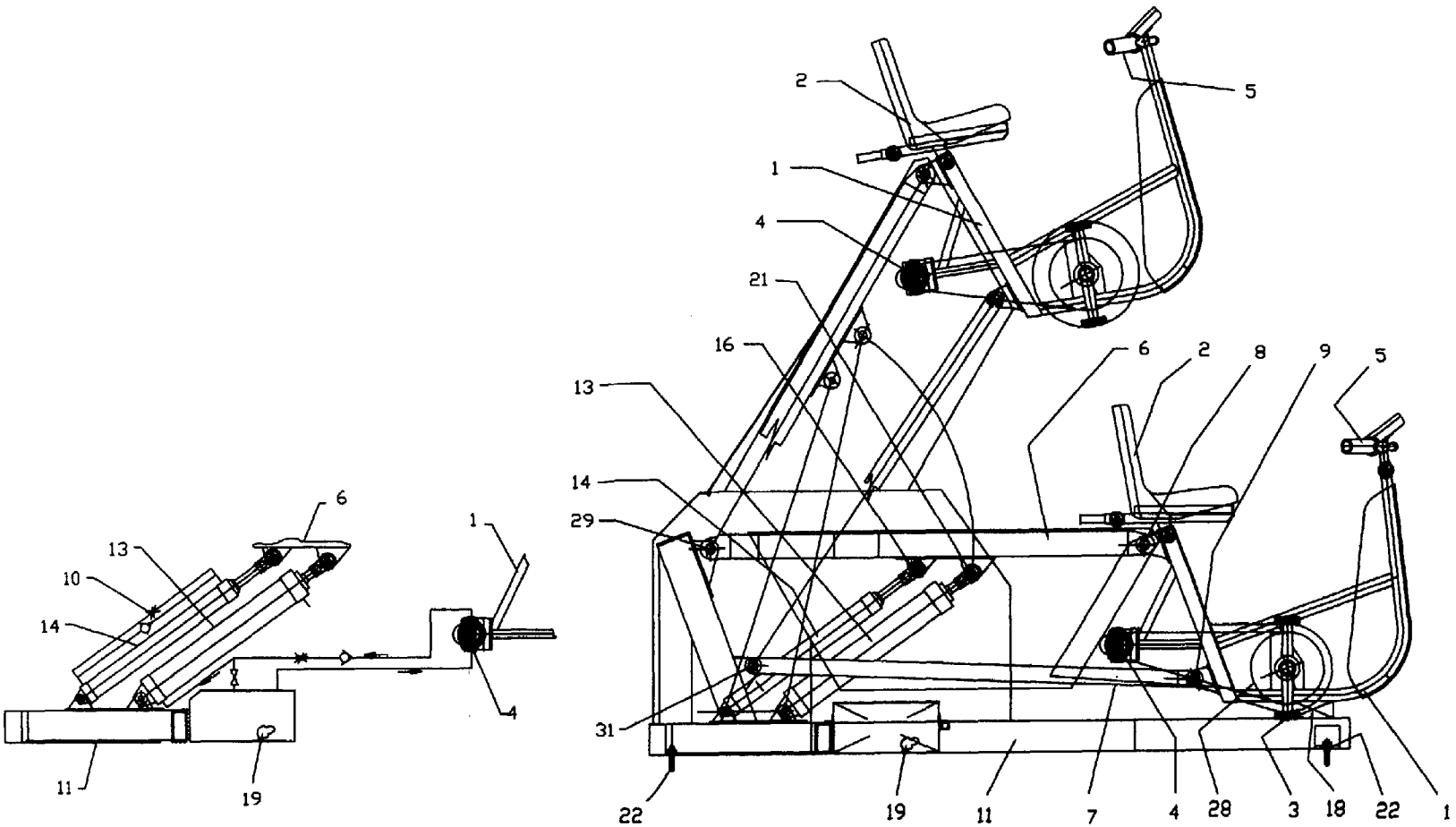
FIG. 1 shows the side elevation cross sectional view of the mechanical arrangement and equipment installation of the ascending exercise bicycle and the connection of the hydraulic pump and oil tank to the actuators or hydraulic cylinders.
Figure 2:
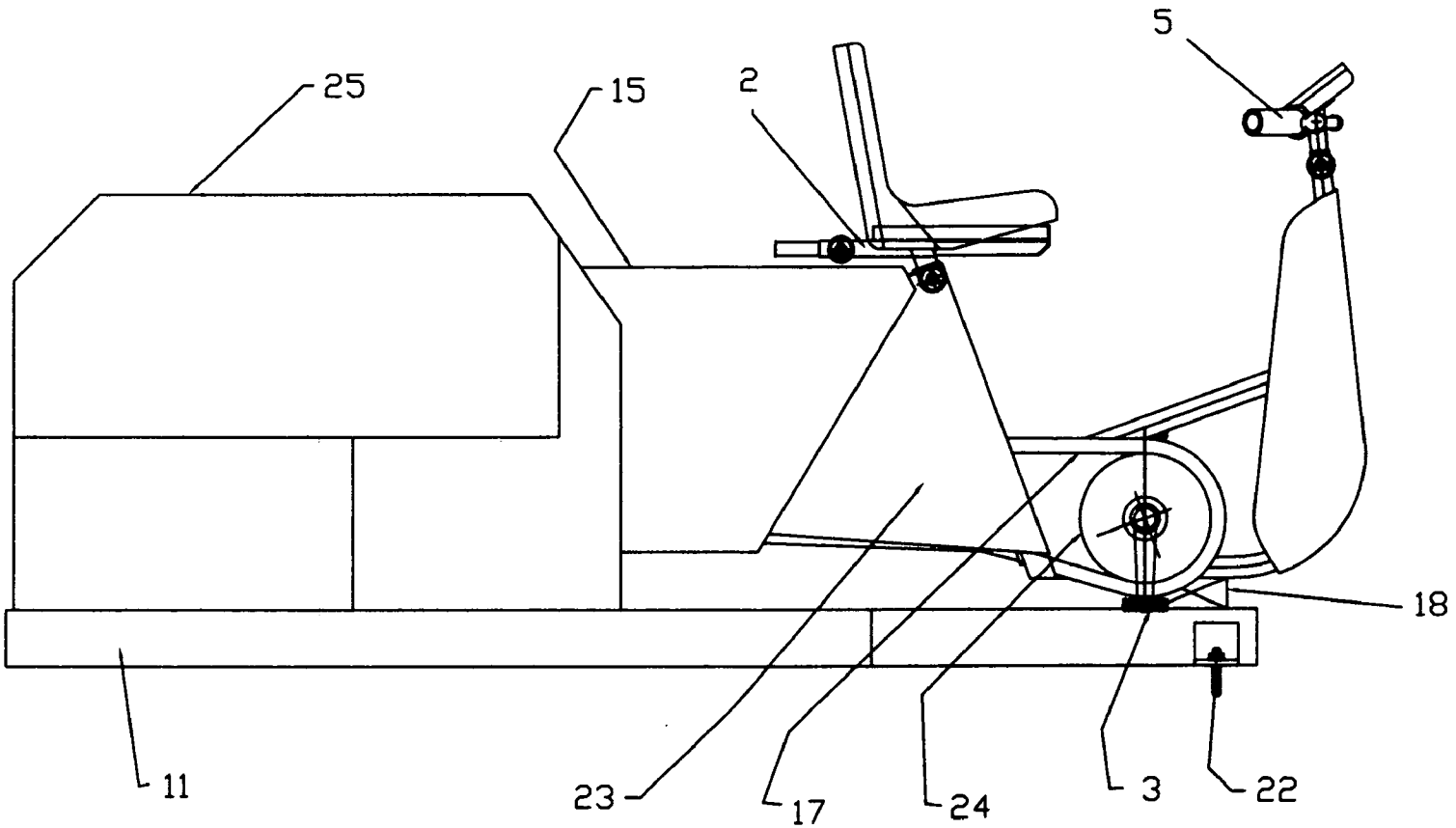
FIG. 2 is the side elevation view of the ascending exercise bicycle fully covered by enclosures.
Figure 3:
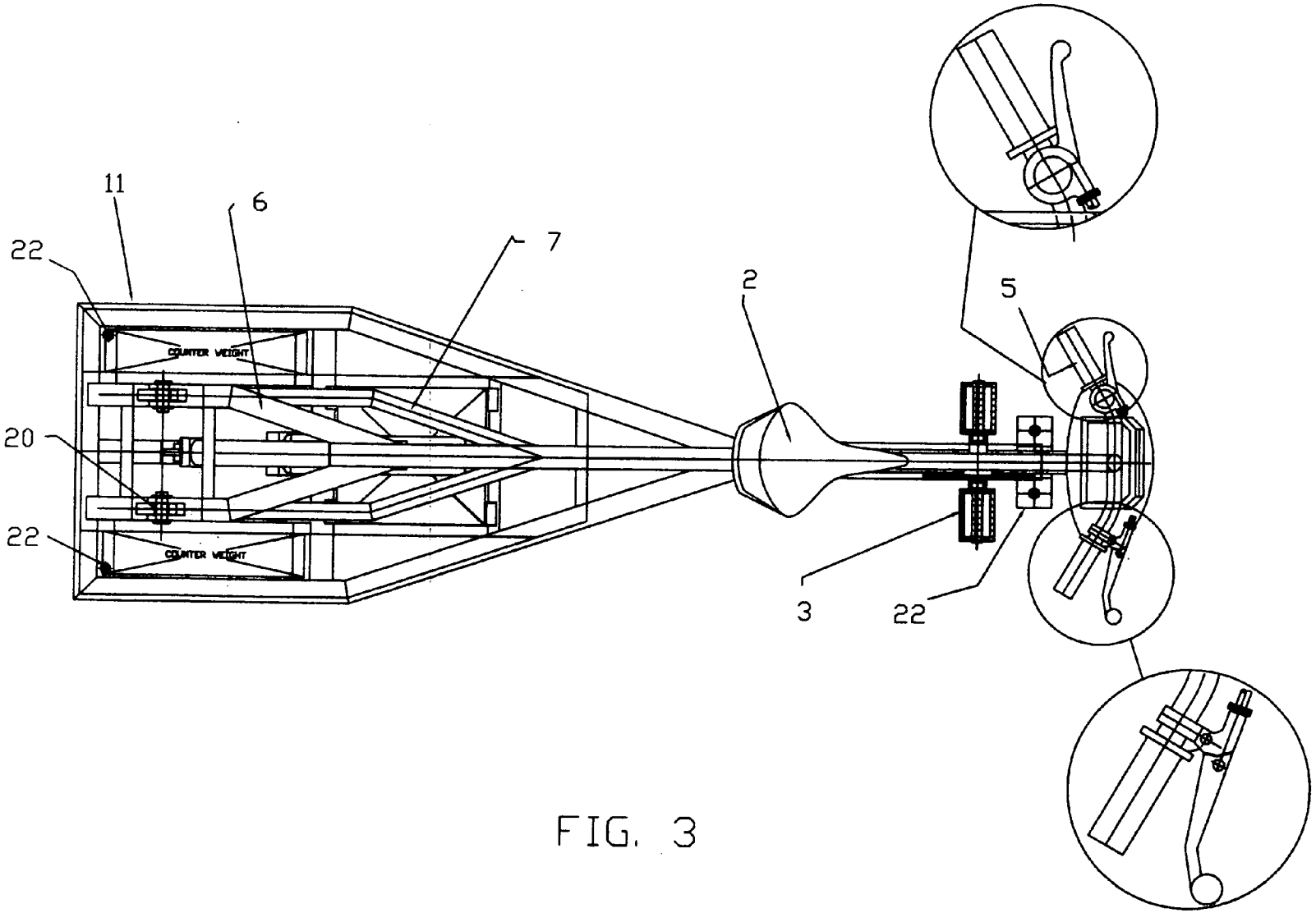
FIG. 3 is the top view of the first embodiment of FIG. 1.
Figure 4:
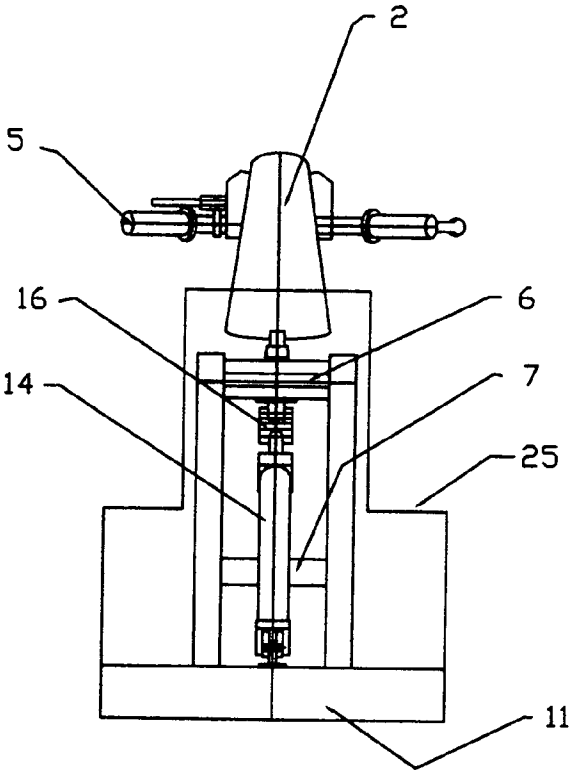
FIG. 4 is the rear view of the first embodiment of FIG. 1.
Figure 5:
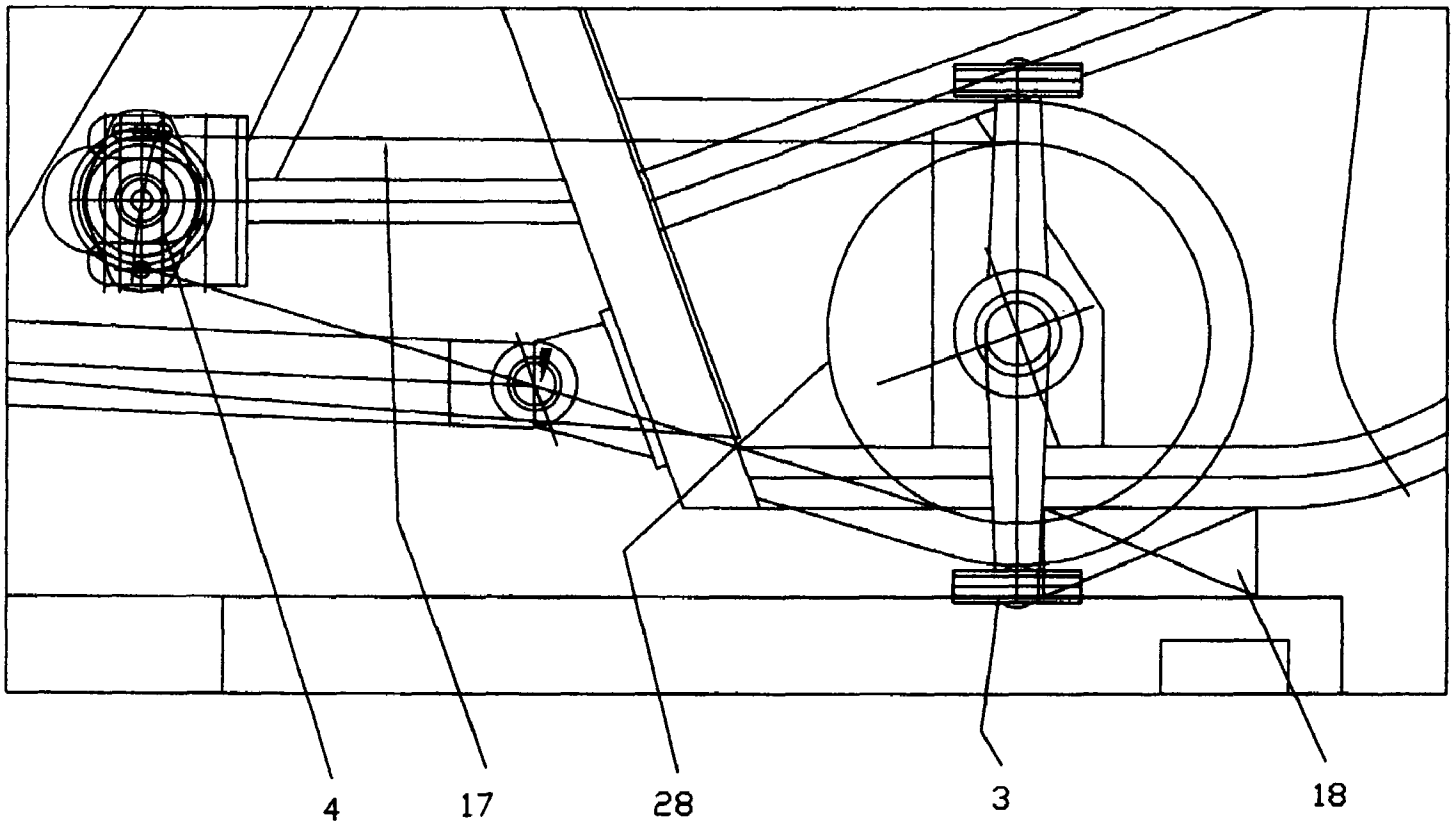
FIG. 5 is the detailed side view of the pump and roller chain drive system.
Figure 6:
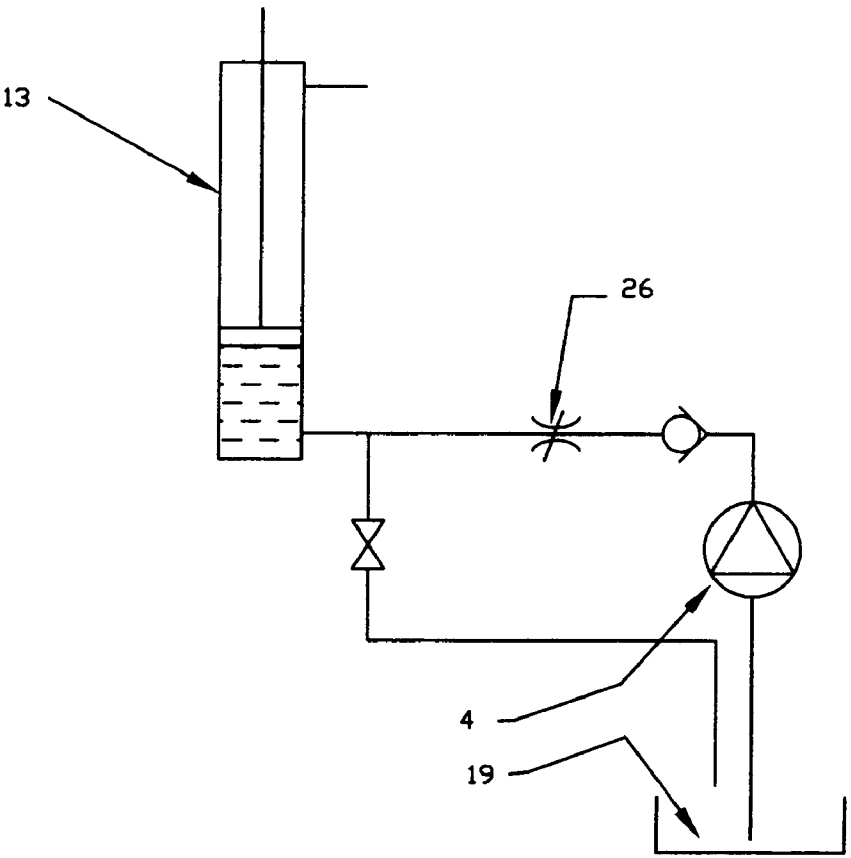
FIG. 6 is the hydraulic schematic of the power and safety system.
Figure 6:
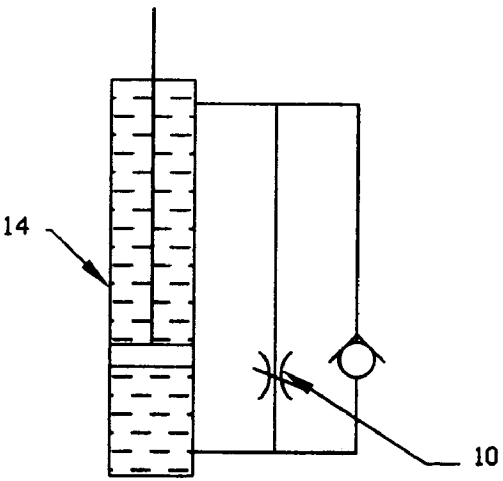

Referring to the drawings, FIG. 1 discloses the embodiment of the invention for a single seat Elevating Exercise Bicycle. The bicycle frame 1 includes a seat and seat adjustment members 2, a control and instrument panel 20, pedaling assembly 3, hydraulic pump 4, hydraulic cylinders 13, 14 and handle bar 5. The inclined vertical tubular member 1A of the bicycle frame that support seat assembly 2 is in turn supported by upper arm 6 and lower arm 7 via connecting pins 8,9 to allow angular movement of the frame 1 from a home rest position to a raised top position. Rear ends of the upper arm 6 and lower arm 7 are also attached to the base frame 11 through the connecting pins 29 and 31 respectively. The top mounting points 21, 16 of the two linear actuators are located substantially at the midpoint of the upper arm 6 and the bottom mounting points of the two linear actuators are located at the base frame member 11. The main actuator or cylinder 13 is controlled by flow control valve 26 to obtain required pedal resistance and timing for each work out cycle.

A hydraulic cylinder piston rod of the main actuator gradually extends to the end of the stroke thereby lifting the bicycle frame to the top position by means of the hydraulic pressure from the hydraulic pump 4. The main actuator or cylinder is also controlled by a pressure release valve 27 to lower the bicycle frame to a home position. Energy is provided to the hydraulic pump to produce hydraulic pressure when an operator rotates the pedals 3 of the drive sprocket 24. The hydraulic pump chain drive is arranged in the same manner as on an ordinary bicycle. The roller chain 17 can be adjusted at the hydraulic pump mounting plate integrated to the bicycle frame 1. At the home position, the bicycle frame 1 rests on the frame support stop 18. The second/auxiliary actuator or cylinder includes a line connected between a lower port and an upper port of the second cylinder. The line includes a flow control valve 10 to control the rate of oil flow from the upper port to the lower port and vice versa such that the auxiliary cylinder can reduce the lowering speed of the bicycle frame in case of a main cylinder failure.

For safety and neat appearance, the mechanical parts and base frame 11 are enclosed by enclosures 15, 23,25 and anchored to the floor at four corners by anchor 22. Hydraulic oil tank 19 is bolted on the base frame 11 below the hydraulic cylinders 13,14. FIG. 1 shows the seat location on both home position and top position when hydraulic cylinder is fully extended or at the end of work cycle.

The invention claimed is:

1. An elevating exercise bicycle comprising:

a bicycle frame having an adjustable seat assembly, an inclined vertical tubular member supporting the seat assembly, an attached handlebar, a control and instrument panel and a pedaling system having a drive chain sprocket, pedals connected to the sprocket, a hydraulic pump and a drive chain interconnecting the drive chain sprocket to the hydraulic pump;

a lifting arm assembly having a base frame adapted to be anchored to a support surface via anchors, an A-frame shaped upper lifting arm and an A-frame shaped lower lifting arm, each pivotally interconnecting the base frame to the bicycle frame to define a substantially parallelogram configuration, a main hydraulic cylinder and an auxiliary hydraulic cylinder, each pivotally interconnecting the upper lifting arm to the base frame, and a hydraulic reservoir tank housed within the base frame; wherein one end of each of the lifting arms is pivotally connected to the base at a distinct location and the opposite end of each of the lifting arms is pivotally connected to the bicycle frame at a distinct location such that the parallelogram configuration and rotation of the pedals by an occupant actuates the hydraulic pump to provide oil from the hydraulic tank to the main cylinder to extend a piston of the main cylinder to lift the bicycle frame from a rest position to a raised position while the pitch angle of the inclined vertical tubular member of the bicycle frame remains substantially constant relative to the base frame.

2. An elevating exercise bicycle as defined in claim 1 further comprising an adjustable pressure release valve connected to the main hydraulic cylinder, a flow control valve connected to the auxiliary hydraulic cylinder and a cushion stop disposed on the base frame wherein the pressure release valve is adapted to be activated to drain oil from the main hydraulic cylinder back to the hydraulic reservoir tank to lower the bicycle frame down to the rest position, the flow control valve is adapted to be activated to adjust the rate of lowering the bicycle frame should the main hydraulic cylinder fail to operate and the cushion stop supports the bicycle frame when the bicycle frame is in the rest position.

* * * * *